United States Patent [19]

Parker et al.

[11] Patent Number: 4,761,668

[45] Date of Patent: Aug. 2, 1988

[54] HIGHLIGHT COLOR PRINTER

[75] Inventors: Delmer G. Parker, Rochester; Howard M. Stark, Webster, both of N.Y.

[73] Assignee: Xerox Corporation, Stamford, Conn.

[21] Appl. No.: 913,181

[22] Filed: Sep. 29, 1986

[51] Int. Cl.[4] ..... G03G 15/08

[52] U.S. Cl. ..... 355/3 DD; 355/14 D; 355/15; 118/652; 430/125

[58] Field of Search ..... 355/3 DD, 140, 4, 15; 118/652; 430/125

[56] References Cited

U.S. PATENT DOCUMENTS

| | | | |
|---|---|---|---|
| 2,297,691 | 10/1942 | Carlson | 95/5 |
| 2,576,047 | 10/1948 | Schaffert | 101/426 |
| 2,647,464 | 8/1953 | Ebert | 101/426 |
| 2,825,814 | 6/1954 | Walkup | 250/49.5 |
| 3,013,890 | 12/1961 | Bixby | 117/17.5 |
| 3,045,644 | 7/1962 | Schwertz | 118/637 |
| 3,816,115 | 6/1974 | Gundlach et al. | 96/1.4 |
| 3,832,170 | 8/1974 | Nagamatsu et al. | 96/1.2 |
| 3,838,919 | 10/1974 | Takahashi | 355/4 |
| 4,068,938 | 1/1978 | Robertson | 355/4 |
| 4,078,929 | 3/1978 | Gundlach | 96/1.2 |
| 4,346,982 | 8/1982 | Nakajima et al. | 355/3 R |
| 4,351,604 | 9/1982 | Karasawa et al. | 355/4 |
| 4,403,848 | 9/1983 | Snelling | 355/4 |
| 4,562,129 | 12/1985 | Tanaka et al. | 430/42 |
| 4,562,130 | 12/1985 | Oka | 430/54 |
| 4,639,124 | 1/1987 | Nye, Jr. et al. | 355/15 |
| 4,669,864 | 6/1987 | Shoji et al. | 355/15 |

*Primary Examiner*—A. C. Prescott

[57] ABSTRACT

Apparatus for minimizing the contamination of one dry toner or developer by another dry toner or developer used for rendering visible latent electrostatic images formed on a charge retentive surface such as a photoconductive imaging member. The apparatus causes the otherwise contaminating dry toner or developer to be attracted to the charge retentive surface in its interdocument and outboard areas. The dry toner or developer so attracted is subsequently removed from the imaging member at the cleaning station.

14 Claims, 1 Drawing Sheet

HIGHLIGHT COLOR PRINTER

BACKGROUND OF THE INVENTION

This invention relates generally to the rendering of latent electrostatic images visible using multiple colors of dry toner or developer and more particularly to the minimization of contamination of one color toner or developer by the other.

The invention can be utilized in the art of xerography or in the printing arts. In the practice of xerography, it is the general procedure to form an electrostatic latent image on a xerographic surface by first uniformly charging a photoconductive insulating surface or photoreceptor (P/R). The charge is selectively dissipated in accordance with a pattern of activating radiation corresponding to original images. The selective dissipation of the charge leaves a latent charge pattern on the imaging surface corresponding to the areas not struck by radiation.

This charge pattern is made visible by developing it with a toner. The toner is generally a colored powder which adheres to the charge pattern by electrostatic attraction.

The developed image is sometimes then fixed to the imaging surface or is transferred to a receiving sheet to which it is fixed.

This method of forming and developing charge patterns is set forth in greater detail in U.S. Pat. No. 2,297,691 to C. F. Carlson. Still other means of forming and developing electrostatic images are set forth in U.S. Pat. No. 2,647,464 to J. P. Ebert; U.S. Pat. No. 2,576,047 to R. M. Schaffert and U.S. Pat. No. 2,825,814 to L. E. Walkup.

Modern business and computer needs oftentimes make it advantageous and desirable to reproduce originals which contain two colors. It is sometimes important that the copy reproduced also contain two colors.

An accounting report having certain information highlighted in a second color is one example of a type of document which would desirably be copied in two colors. Computer generated cathode ray tube (CRT) displays are another example in which it is sometimes desirable to reproduce an image in two colors. For instance, it is sometimes desirable that those portions of the CRT display image representing permanent forms are reproduced in a first color and those portions of the image representing variable information are reproduced in a second color.

Several useful methods are known for making copies having two colors. Some of these methods make high quality images in two colors, however, there is need for improvements in these methods. In particular, improvements relating to the minimization of contamination of one dry developer or toner by another are highly desirable.

One method of two-color reproduction is disclosed in U.S. Pat. No. 3,013,890 to W. E. Bixby in which a charge pattern of either a positive or negative polarity is developed by a single, two-colored developer. The developer of Bixby comprises a single carrier which supports both triboelectrically relatively positive and relatively negative toner. The positive toner is a first color and the negative toner is of a second color. The method of Bixby develops positively charged image areas with the negative toner and develops negatively charged image areas with the positive toner. A two-color image occurs only when the charge pattern includes both positive and negative polarities.

Two-color development of charge patterns created by the Tesi technique is disclosed by F. A. Schwertz in U.S. Pat. No. 3,045,644. Like Bixby, Schwertz develops charge patterns which are of both a positive and negative polarity. Schwertz's development system is a set of magnetic brushes, one of which applies relatively positive toner of a first color to the negatively charged areas of the charge pattern and the other of which applies relatively negative toner to the positively charged areas.

Methods and apparatus for making colored xerographic images using colored filters and multiple development and transfer steps are disclosed, respectively, in U.S. Pat. Nos. 3,832,170 to K. Nagamatsu et al and 3,838,919 to T. Takahashi.

U.S. Pat. No. 3,816,115 to R. W. Gundlach and L. F. Bean discloses a method for forming a charge pattern having charged areas of a higher and lower strength of the same polarity. The charge pattern is produced by repetitively charging and imagewise exposing an overcoated xerographic plate to form a composite charge pattern. Development of the charge pattern in one color is disclosed.

A method of two-color development of a charge pattern, preferably with a liquid developer, is disclosed in the commonly assigned U.S. Pat. No. 4,068,938 issued on Jan. 17, 1978. This method requires that the charge pattern for attracting a developer of one color be above a first threshold voltage and that the charge pattern for attracting the developer of the second color be below a second threshold voltage. The second threshold voltage is below the first threshold voltage. Both the first and second charge patterns have a higher voltage than does the background.

Still another method of creating two-color images, as disclosed in U.S. Pat. No. 4,078,929, utilizes a charge pattern of only one polarity on an imaging surface. The charge pattern includes charged areas at one voltage level corresponding to background voltages and charged image areas at two other voltage levels different from the background level. One of the image voltages is greater in magnitude than the background voltage and the other is smaller in magnitude.

The charge pattern in the U.S. Pat. No. 4,078,929 is developed with toner particles of first and second color. The toner particles of one of the colors is positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

As disclosed in U.S. Pat. No. 4,403,848 a multi-color printer uses an additive color process to provide either partial or full color copies. Multiple scanning beams, each modulated in accordance with distinct color image signals, are scanned across the printer's photoreceptor at relatively widely separated points, there being buffer means provided to control timing of the different color image signals to assure registration of the color images with one another. Each color image is developed prior to scanning of the photoreceptor by the next succeeding beam. Following developing of the last color image, the composite color image is transferred to a copy sheet. In an alternate embodiment, an input section for scanning color originals is provided. The color image signals output by the input section may then be used by the printing section to make full color copies of the original.

In U.S. Pat. No. 4,562,129 there is disclosed an image forming method comprising the steps of forming a latent electrostatic image having at least three different potential levels on a photosensitive member, and developing the latent electrostatic image with a developer to obtain a monochromatic or dichromatic copy image, the developer being composed of at least two components of a nonmagnetic insulating toner and a high-resistivity magnetic carrier triboelectrically chargeable with the toner and having a high resistivity of at least $10<12>$ ohm-cm, the carrier being in the form of particles about 5 to about 40 microns in size, prepared by dispersing a magnetic fine powder in an insulating resin and containing the magnetic fine powder in a proportion of 50 to 75% by weight.

U.S. Pat. No. 4,562,130 relates to a composite image forming method having the following features: (A) Forming a composite latent electrostatic image of potentials at three different levels by two image exposures, the potential of the background area (nonimage area) resulting from the first image exposure is corrected to a stable intermediate potential which is constant at all times by charging the area with scorotron charging means. Accordingly the image can be developed to a satisfactory copy image free from fog. (B) The composite latent electrostatic image is developed by a single developing device collectively, or by two developing devices. In the latter case, the composite latent image is not developed after it has been formed, but the latent image resulting from the first exposure is developed first before the second exposure, and the latent image resulting from the second exposure is thereafter developed, whereby the fog due to an edging effect is prevented whereby there is produced a satisfactory copy image.

In U.S. Pat. No. 4,346,982, there is disclosed an electrophotographic recording device having means for uniformly charging the surface of a light-sensitive recording medium, means for forming latent images on said light-sensitive recording medium and means for developing said latent images into visual images, said electophotographic recording device being characterized in that said means for forming latent images on said light-sensitive recording medium comprises a plurality of exposing means for exposing a positive optical image and a negative optical image in such a manner that the light receiving region of said negative optical image overlaps the light receiving region of said positive optical image, whereby a latent image is formed on the surface of said light-sensitive recording medium consisting of a first area which does not receive any light of said negative or positive image and holds an original potential, a second area which receives the light of only said positive image and holds a reduced potential from that of said original potential and a third area which receives the light of both of said negative image and said positive image and holds a further reduced potential than said reduced potential of said second area.

Turning now to the problem of contamination of one dry toner by another dry toner, the known prior will be discussed thereto.

It is known that positioning the developer housing containing the darker (i.e. black) toner first and positioning the developer housing containing the lighter colored toner second minimizes the effect of such contamination. See the U.S. Pat. No. 4,078,929 discussed above.

It is known in the prior art to remove contaminants from a second developer housing which has become contaminated by toner from a first housing. Such a feature is disclosed in U.S. Pat. No. 4,351,604. As disclosed therein, first and second developing units apply toners of first and second colors respectively to a photoconductive drum carrying a bipolar electrostatic image to form a bicolor image. A small amount of the toner is scraped off the drum in the second developing step and becomes mixed with the second developing toner in the second developing unit. The admixed first toner is separated and removed from the second toner by a separation member in the form of a roller, belt or mesh screen covered electrode which is charged to a polarity opposite to the first toner. Thus, the member electrostatically attracts the toner while repelling the second toner. It is stated in the U.S. Pat. No. 4,351,604 that "In a copying apparatus using liquid toners the first toner may be removed from the second toner by making use of an electrically charged, non-image area of the dielectric member. However, this expedient is not usable in dry copying apparatus." (See col. 1, lines 27–31)

It is also known to remove contaminants such as debris prior to the use of the developer for its intended purpose. Such an arrangement is disclosed in U.S. patent application Ser. No. 718,615 wherein a biased roller is disposed in the developer housing at a location suitable for removing debris such as paper fibers from the toner prior to use for developing the images. As noted hereinabove it is desirable to minimize the contamination of one toner by the other. Such contamination renders the developing characteristics of that system unstable.

BRIEF DESCRIPTION OF THE INVENTION

Our invention relates to an imaging process for producing multiple color images. Such a process is also known as highlight color imaging and tri-level xerography. The present invention is directed to a highlight color process wherein the two different colored images are developed in a single pass of the photoreceptor past a pair of developer housings. As presently contemplated, in order to carry out the invention, the charge retentive surface, initially charged to a voltage $V_0$, is discharged to $V_0/2$ imagewise in the background (white) image areas and to substantially (i.e. 70 volts) zero or ground potential in the highlight (i.e. color other than black) parts of the image. There are two developer housings, one containing positive toner and the other negative toner. The charge retentive surface containing the images is moved past these housings in a single pass. Color discrimination in the development of the electrostatic latent image is achieved by electrically biasing the two housings to a voltage which is offset from the background voltage $V_0/2$, the direction of offset depending on the toner in the housing. One housing contains black developer having triboelectric properties so that it is driven or attracted to the $V_0$ charged areas of the latent images by the electric field established between the $V_0$ charged areas of the P/R and the bias voltage level of that biased developer housing. The other housing contains developer that is triboelectrically charged so that it is attracted or driven to to the discharged parts of the P/R.

Prior to transfer of the two color image, it is subjected to a pretransfer corona discharge to condition the toner for effective transfer to a substrate using corona discharge.

A practical problem, as noted above, which is encountered in single-pass, highlight color imaging using charged area development (CAD) for one color and discharged area development (DAD) for the other color is the accumulation of wrong color/sign toner in the second development housing. This leads to the development characteristics of the second developer system becoming unsatisfactory.

According to our invention, the contamination of the second developer housing with dry toner from the first housing is minimized by conditioning the P/R so that toner that finds its way into the second developer housing, is attracted thereto. Such conditioning is effected in the inter-document zone and margins outside the the document area.

An electrostatic field for attracting the toner to the P/R in the above noted areas can be generated in different ways. For example, a corotron is positioned between the two developer housings. The corotron so positioned is used to charge the appropriate areas of the P/R to a potential greater than $V_0/2$. By so doing, the wrong sign toner in the second housing is presented with a surrogate charged image area on the P/R so that the wrong sign/color toner is attracted to the P/R.

Alternatively, the same surrogate charged image area can be generated in the second housing by switching the electrical bias thereon to a level below $V_0/2$. The wrong sign/color toner is then removed at the cleaning station.

The foregoing examples of field creation are effected with the developer housing for developing the charged area of the photoreceptor being first and the housing for developing the discharged area being second. The positions of the two developer systems (i.e DAD and CAD) is reversed in a second embodiment of our invention in which case the field is established by discharging the P/R in the non-image areas with an illumination source after these areas pass the first developer housing. Alternatives to using the illumination source are to shift the bias on the second developer housing or to use a corona discharge device in lieu of the illumination source.

DETAILED DESCRIPTION OF THE PREFERRED EMBODIMENTS OF THE INVENTION

For a general understanding of the features of the present invention, a description thereof will be made with references to the drawings.

Figure 1:
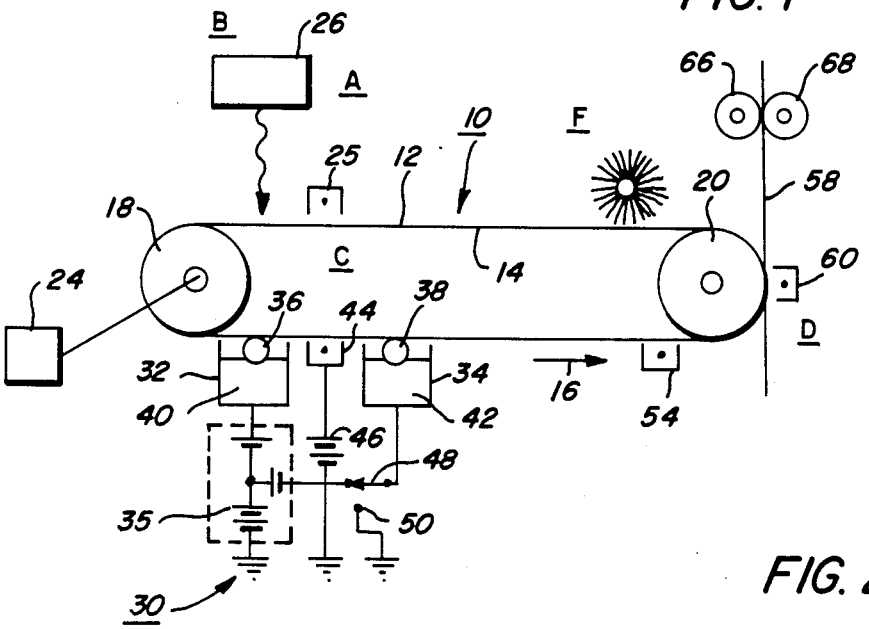
FIG. 1 is a schematic view of an electrophotographic printing machine incorporating the features of the present invention therein.
Figure 2:
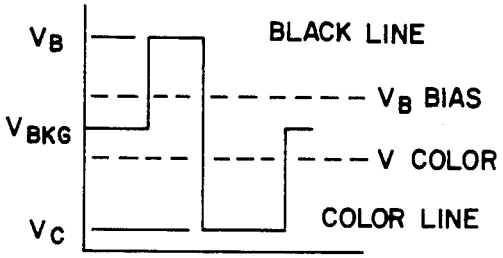
FIG. 2 is a plot of photoreceptor potential illustrating single-pass, highlight color latent image characteristics.

FIG. 1 schematically depicts the various components of an illustrative electrophotographic printing machine incorporating the present invention. In as much as the art of electrophotographic printing is well known, the various processing stations employed in the printing machine illustrated in FIG. 1 will be described only briefly.

As shown in FIG. 1, the printing machine utilizes a photoconductive belt 10 which consists of a photoconductive surface 12 and an electrically conductive substrate 14. Belt 10 moves in the direction of arrow 16 to advance successive portions thereof sequentially through the various processing stations disposed about the path of movement thereof. Belt 10 is entrained about a pair of rollers 18 and 20, the former of which can be used as a drive roller and the latter of which can be use to provide suitable tensioning of the P/R belt 10. Motor 24 rotates roller 18 to advance belt 10 in the direction of arrow 16. Roller 18 is coupled to motor 24 by suitable means such as a belt drive.

As can be seen by further reference to FIG. 1, initially a portion of belt 10 passes through charging station A. At charging station A, a corona discharge device such as a scorotron or corotron indicated generally by the reference numeral 25, charges the belt 10 to a selectively high uniform potential, $V_0$.

Next, the charged portion of photoconductive surface is advanced through exposure station B. At exposure station B, The uniformly charged photoreceptor or charge retentive surface 10 is exposed to a laser based input and/or output scanning device which causes the charge retentive surface to be discharged in accordance with the output from the scanning device.

The P/R which is initially charged to a voltage $V_0$, is discharged to $V_0/2$ imagewise in the background (white) image areas and to zero or ground potential in the highlight (i.e. color other than black) parts of the image. At development station C, a magnetic brush development system, indicated generally by the reference numeral 30 advances developer materials into contact with the electrostatic latent images. The development system 30 comprises first and second developer housings 32 and 34. Preferably, the magnetic brush development housings include two magnetic brush developer rollers 36 and 38. These rollers each advance their respective developer materials into contact with the latent image. Each developer roller forms a brush comprising toner particles which are attracted by the latent images on the P/R.

One of the two developer housings contains positive toner 40 and the other negative toner 42. The charge retentive surface containing the images is moved past these housings in a single pass. Color discrimination in the development of the electrostatic latent image is achieved by electrically biasing the two housings 32 and 34 to a voltage equal to a voltage which is offset from the background voltage $V_0/2$. To this end there is provided a dc power supply 35 including a pair of voltage sources $V_{black\ bias}$ and $V_{c\ bias}$. In the case of the housing 32 containing black toner the shift is toward $V_0$ and in the case of the housing 34 the shift is toward the zero voltage level.

Figure 3:
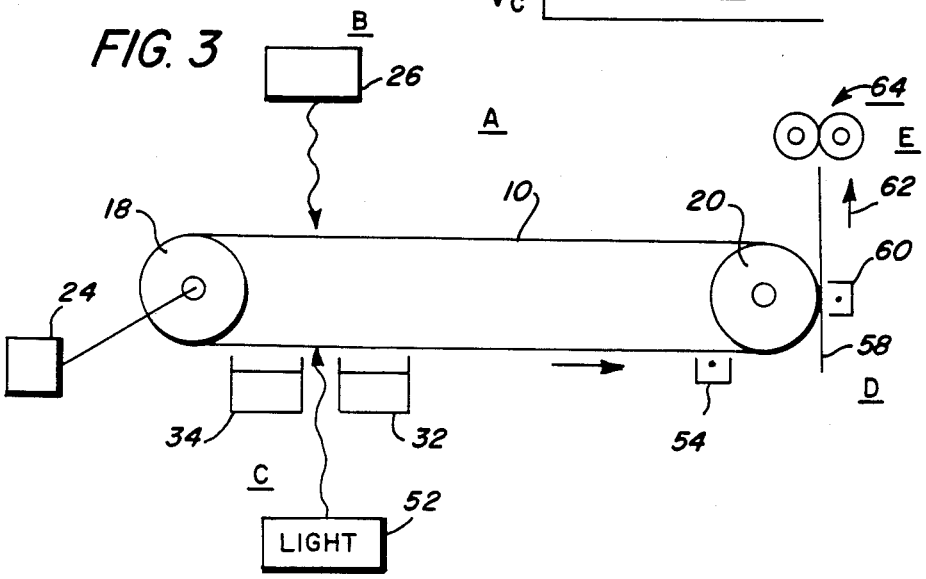
FIG. 3 is schematic illustration of a modified form of the invention illustrated in FIG. 1.

In the embodiment of the invention disclosed in FIG. 1, the housing 32 contains black developer having triboelectric properties so that it is driven or attracted to the $V_0$ charged areas of the latent images by the electrostatic field established between the $V_0$ charged areas of the P/R and the voltage level of the biased developer housing. The housing 34 contains developer that is triboelectrically charged so that it is attracted or driven to to the discharged parts of the P/R. The latent image characteristics are depicted in FIG. 3.

A practical problem, as noted above, which is encountered in single-pass, highlight color imaging using charged area development (CAD) for one color and discharged area development (DAD) for the other color is the accumulation of wrong color/sign toner in the second development housing. This leads to in the development characteristics of the second developer system becoming unsatisfactory.

According to our invention, the contamination of the second developer housing with dry toner from the first housing is minimized by conditioning the P/R so that toner, that finds its way into the second developer housing, is attracted thereto. Such conditioning is effected in the inter-document zone and margins outside the the document area.

The field for attracting the toner to the P/R in the above noted areas can be generated in different ways. For example, as disclosed in FIG. 1, a corotron 44 or other suitable corona discharge device is positioned between the two developer housings 32 and 34. The corotron so positioned is used to charge the the appropriate areas of the P/R to a potential greater than the voltage $V_0/2$ to which the developer housing 34 is biased. The bias voltage for the corotron is provided by a dc source 46. Thus, the wrong sign toner in the second housing is presented with a surrogate charged image area so that the wrong sign/color toner is attracted to the P/R while the toner 42 is repelled from the P/R in the nonimage areas.

Alternatively, the same surrogate charged image area can be generated in the second housing by switching the electrical bias thereon to a level below $V_0/2$. For this purpose a switch 48 is provided which is capable of connecting the developer housing 34 to the power source 35 or a ground connection 50. After being transferred to the P/R in the foregoing manner the wrong sign/color toner which is attracted to the non-image areas of the P/R is then removed at the cleaning station.

The foregoing examples of wrong sign/color purging are effected with the developer housing for developing the charged area of the photoreceptor being first in the path of movement of the images and the housing for developing the discharged area being second in that path. The positions of the two developer systems (i.e DAD and CAD) are reversed in the embodiment illustrated in FIG. 3. In this embodiment, the field for attracting wrong sign/color toner to the non-image areas of the P/R is established by discharging the P/R in the non-image areas with an illumination source 52 after these areas pass the first developer housing.

Prior to transfer of the two color images they are subjected to a pre-transfer corotron discharge to bring all the toner to a common sign so it can be transferred to a substrate using corona discharge of the opposite polarity. A corotron 54 is provided for such pre-transfer.

As successive electrostatic latent images are developed, toner particles are depleted from the developer material. Toner particle dispensers, not shown, are arranged to furnish additional toner particles to housings 32 and 34 for subsequent use by developer rollers disposed therein.

A sheet of support material 58 is moved into contact with the toner image at transfer station D. The sheet of support material is advanced to transfer station D by conventional sheet feeding apparatus, not shown. Preferably, sheet feeding apparatus includes a feed roll contacting the uppermost sheet of a stack of copy sheets. Feed rolls rotate so as to advance the uppermost sheet from a stack into a chute which directs the advancing sheet of support material into contact with photoconductive surface 12 of belt 10 in a timed sequence so that the toner powder image developed thereon contacts the advancing sheet of support material at transfer station D.

Transfer station D includes a corona generating device 60 which sprays ions of a suitable polarity onto the backside of sheet 58. This attracts the charged toner powder images from photoconductive surface 12 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a back-up roller 68. Sheet 58 passes between fuser roller 66 and back-up roller 68 with the toner powder image contacting fuser roller 66. In this manner, the toner powder image is permanently affixed to sheet 58. After fusing, a chute, not shown, guides the advancing sheet 58 to catch tray, also not shown, for subsequent removal from the printing machine by the operator.

After the sheet of support material is separated from photoconductive surface of belt 10, the residual toner toner particles and the wrong sing/color toner particles carried by the non-image areas on the P/R are removed therefrom. These particles are removed from photoconductive surface at cleaning station F.

Subsequent to cleaning, discharge lamp (not shown) floods the photoconductive surface with light to dissipate any residual electrostatic charge remaining prior to the charging thereof for the successive imaging cycle.

What is claimed is:

1. Method of removing one of a plurality of dry toners from a developer housing used to render visible latent images contained on a charge retentive surface, said method including the steps of:

moving said charge retentive surface with latent electrostatic images thereon past a plurality of developer housings; and placing electrostatic charges on non-image areas of said charge retentive surface and electrically biasing one of said developer housings to create an electrostatic field between said developer housing and said charge retentive surface for causing said one of said plurality of dry toners to be attracted to said charge retentive surface in said non-image areas while causing repulsion of another of said plurality of dry toners from said detoning member.

2. The method according to claim 1 including the steps of moving the dry toner attracted to the non-image areas to a cleaning station and removing thereat.

3. Apparatus for removing one of a plurality of dry toners from one of a plurality of developer housings used to render visible latent images contained on a charge retentive surface, said apparatus comprising:

a detoning member positioned adjacent and outside of said developer housing;

means for creating an electrostatic field between one of said developer housings and said detoning member for causing said one of said plurality of toners to be attracted to said detoning member and causing repulsion of another of said plurality of toners from said detoning member; and means for moving said detoning member past said one of a plurality of developer housings for causing said one of said plurality of toners to be attracted to said detoning member and causing repulsion of another of said plurality of toners from said detoning member and transporting said one of a plurality of dry toners to a cleaning station.

4. Apparatus according to claim 3 wherein said detoning member comprises a charge retentive surface.

5. Apparatus according to claim 4 wherein said means for creating an electrostatic field comprises means for varying the electrostatic charge on non-image areas of said charge retentive surface.

6. Apparatus according to claim 5 wherein said electrostatic charge varying means comprises an electrostatic discharge device.

7. Apparatus according to claim 6 wherein electrostatic charge varying means comprises a light source.

8. Image creation apparatus including structure for uniformly charging a charge retentive surface, discharging said surface to form latent images thereon and rendering said images visible through the application of dry toner contained in a plurality of developer housings, the improvement comprising:

a detoning member positioned adjacent and outside of said developer housing;

means for creating an electrostatic field between said developer housing and said detoning member for causing said one of said plurality of toners to be attracted to said detoning member and causing repulsion of another of said plurality of toners from said detoning member; and means for moving said detoning member past said one of a plurality of developer housings for causing said one of said plurality of toners to be attracted to said detoning member and causing repulsion of another of said plurality of toners from said detoning member and transporting said one of a plurality of dry toners to a cleaning station.

9. Apparatus according to claim 8 wherein said detoning member comprises a charge retentive surface.

10. Apparatus according to claim 9 wherein said means for creating an electrostatic field comprises means for varying the electrostatic charge on non-image areas of said charge retentive surface.

11. Apparatus according to claim 10 wherein said electrostatic charge varying means is positioned intermediate said developer housings.

12. Apparatus according to claim 11 wherein said electrostatic charge varying means comprises an electrostatic discharge device.

13. Apparatus according to claim 12 wherein electrostatic charge varying means comprises a light source.

14. Apparatus according to claim 4 wherein said means for creating an electrostatic field comprises means for varying the electrical bias on said developer housing.

* * * * *